US008764394B2

(12) United States Patent
Lee et al.

(10) Patent No.: US 8,764,394 B2
(45) Date of Patent: Jul. 1, 2014

(54) COMPONENT COOLING CHANNEL

(75) Inventors: Ching-Pang Lee, Cincinnati, OH (US); John J. Marra, Winter Springs, FL (US); Gary B. Merrill, Orlando, FL (US); Benjamin E. Heneveld, Newmarket, NH (US); Jill Klinger, Charlottesville, VA (US)

(73) Assignees: Siemens Energy, Inc., Orlando, FL (US); Mikro Systems, Inc., Charlottesville, VA (US)

( * ) Notice: Subject to any disclaimer, the term of this patent is extended or adjusted under 35 U.S.C. 154(b) by 770 days.

(21) Appl. No.: 12/985,553

(22) Filed: Jan. 6, 2011

(65) Prior Publication Data

US 2012/0177503 A1 Jul. 12, 2012

(51) Int. Cl.

| | |
|---|---|
| ***F01D 5/18*** | (2006.01) |
| ***F28F 3/04*** | (2006.01) |
| *F28F 7/02* | (2006.01) |

(52) U.S. Cl.

CPC ..... *F01D 5/187* (2013.01); *F05D 2260/2214* (2013.01); *F28F 3/048* (2013.01); *F05D 2240/304* (2013.01); *F05D 2250/13* (2013.01); *F28F 7/02* (2013.01)

USPC ..... 416/97 R

(58) Field of Classification Search

CPC ..... F05D 2260/2214

USPC ..... 415/115; 416/96 R, 97 R; 165/168, 177

See application file for complete search history.

(56) References Cited

U.S. PATENT DOCUMENTS

| | | | | | |
|---|---|---|---|---|---|
| 5,215,431 | A | * | 6/1993 | Derrien | 415/115 |
| 5,370,499 | A | | 12/1994 | Lee | |
| 5,496,151 | A | | 3/1996 | Coudray et al. | |
| 5,498,133 | A | | 3/1996 | Lee | |
| 5,503,529 | A | | 4/1996 | Anselmi et al. | |
| 5,511,946 | A | | 4/1996 | Lee et al. | |
| 5,586,866 | A | | 12/1996 | Wettstein | |
| 5,629,834 | A | * | 5/1997 | Kodama et al. | 361/695 |
| 5,690,473 | A | | 11/1997 | Kercher | |
| 5,695,321 | A | * | 12/1997 | Kercher | 416/97 R |
| 5,752,801 | A | * | 5/1998 | Kennedy | 415/115 |
| 5,813,836 | A | | 9/1998 | Starkweather | |
| 6,086,328 | A | | 7/2000 | Lee | |
| 6,190,129 | B1 | | 2/2001 | Mayer et al. | |
| 6,254,334 | B1 | | 7/2001 | LaFleur | |
| 6,273,682 | B1 | | 8/2001 | Lee | |
| 6,289,981 | B1 | * | 9/2001 | Tokizaki et al. | 165/177 |
| 6,379,118 | B2 | | 4/2002 | Lutum et al. | |
| 6,514,042 | B2 | | 2/2003 | Kvasnak et al. | |
| 6,874,987 | B2 | | 4/2005 | Slinger et al. | |
| 6,932,570 | B2 | | 8/2005 | Heyward et al. | |
| 6,969,237 | B2 | | 11/2005 | Hudson | |

(Continued)

*Primary Examiner* — Liam McDowell

(57) ABSTRACT

A cooling channel (36, 36B) cools an exterior surface (40 or 42) or two opposed exterior surfaces (40 and 42). The channel has a near-wall inner surface (48, 50) with a width (W1). Interior side surfaces (52, 54) may converge to a reduced channel width (W2). The near-wall inner surface (48, 50) may have fins (44) aligned with a coolant flow (22). The fins may highest at mid-width of the near-wall inner surface. A two-sided cooling channel (36) may have two near-wall inner surfaces (48, 50) parallel to two respective exterior surfaces (40, 42), and may have an hourglass shaped transverse sectional profile. The tapered channel width (W1, W2) and the fin height profile (56A, 56B) increases cooling flow (22) into the corners (C) of the channel for more uniform and efficient cooling.

18 Claims, 3 Drawing Sheets

(56) References Cited

U.S. PATENT DOCUMENTS

| | | | | |
|---|---|---|---|---|
| 6,981,840 | B2 | 1/2006 | Lee et al. | |
| 6,984,102 | B2 | 1/2006 | Bunker et al. | |
| 7,011,502 | B2 | 3/2006 | Lee et al. | |
| 7,044,210 | B2 * | 5/2006 | Usui | 165/177 |
| 7,080,972 | B2 | 7/2006 | Rawlinson | |
| 7,114,923 | B2 | 10/2006 | Liang | |
| 7,131,818 | B2 | 11/2006 | Cunha et al. | |
| 7,182,576 | B2 | 2/2007 | Bunker et al. | |
| 7,186,084 | B2 | 3/2007 | Bunker et al. | |
| 7,273,351 | B2 | 9/2007 | Kopmels | |
| 7,296,973 | B2 | 11/2007 | Lee et al. | |
| 7,328,580 | B2 * | 2/2008 | Lee et al. | 60/752 |
| 7,414,839 | B2 * | 8/2008 | Yu et al. | 361/695 |
| 7,544,044 | B1 | 6/2009 | Liang | |
| 7,563,072 | B1 | 7/2009 | Liang | |
| 7,665,956 | B2 | 2/2010 | Mitchell et al. | |
| 8,092,175 | B2 * | 1/2012 | Beeck et al. | 416/95 |
| 8,092,177 | B2 * | 1/2012 | Liang | 416/96 R |
| 8,151,617 | B2 * | 4/2012 | Feng et al. | 72/379.6 |
| 2005/0274506 | A1 * | 12/2005 | Bhatti et al. | 165/177 |
| 2007/0258814 | A1 * | 11/2007 | Metrisin et al. | 416/97 R |
| 2012/0034077 | A1 * | 2/2012 | Jairazbhoy et al. | 415/203 |

* cited by examiner

FIG 2
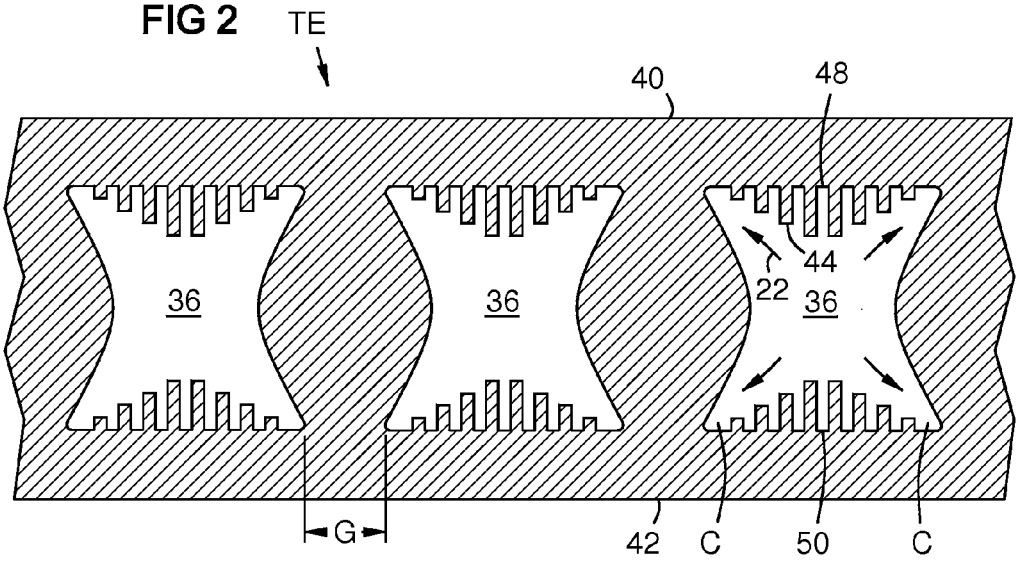
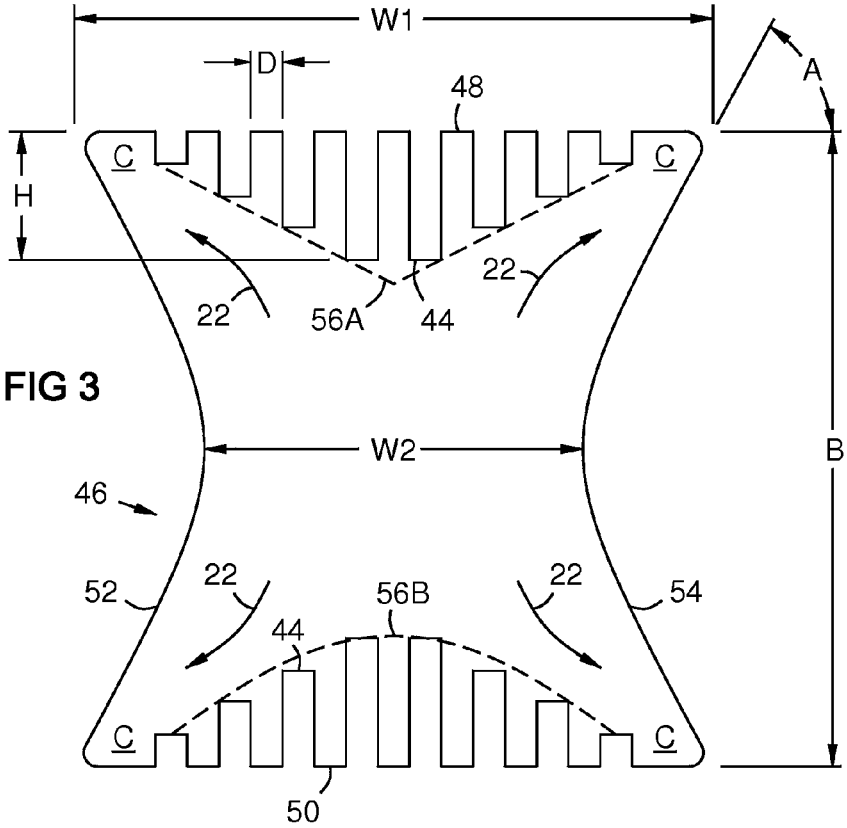
FIG 3

COMPONENT COOLING CHANNEL

FIELD OF THE INVENTION

The invention relates to near-wall cooling channels for gas turbine components such as blades, vanes, and shroud elements.

BACKGROUND OF THE INVENTION

Components in the hot gas flow path of gas turbines often have internal cooling channels. Cooling effectiveness is important in order to minimize thermal stress on these components. Cooling efficiency is important in order to minimize the volume of air diverted from the compressor for cooling. Film cooling provides a film of cooling air on outer surfaces of a component via holes from internal cooling channels. Film cooling can be inefficient, because so many holes are needed that a high volume of cooling air is required. Thus, film cooling has been used selectively in combination with other techniques. Impingement cooling is a technique in which perforated baffles are spaced from a back surface of a component opposite a heated surface to create impingement jets of cooling air against the back surface. It is also known to provide serpentine cooling channels in a component.

The trailing edge portion of a gas turbine airfoil may include up to about ⅓ of the total airfoil external surface area. A trailing edge is thin for aerodynamic efficiency, so it receives heat input on its two opposed exterior surfaces that are relatively close to each other, and thus a relatively high coolant flow rate is required to maintain mechanical integrity. Trailing edge cooling channels have been configured in various ways to increase efficiency. For example U.S. Pat. No. 5,370,499 discloses a mesh of coolant exit channels in the trailing edge. Trailing edge exit channels commonly have a transverse sectional profile that is rectangular, circular, or oval.

The present invention increases heat transfer efficiency and uniformity in cooling channels such as those in the trailing edge of turbine airfoils, thus reducing the coolant flow volume needed.

BRIEF DESCRIPTION OF THE DRAWINGS

The invention is explained in the following description in view of the drawings that show:

FIG. 2 is a sectional view of an airfoil trailing edge taken on line 2-2 of FIG. 1, with cooling channels showing aspects of the invention.

FIG. 3 is a transverse profile of a cooling channel per aspects of the invention.

DETAILED DESCRIPTION OF THE INVENTION

Figure 1:
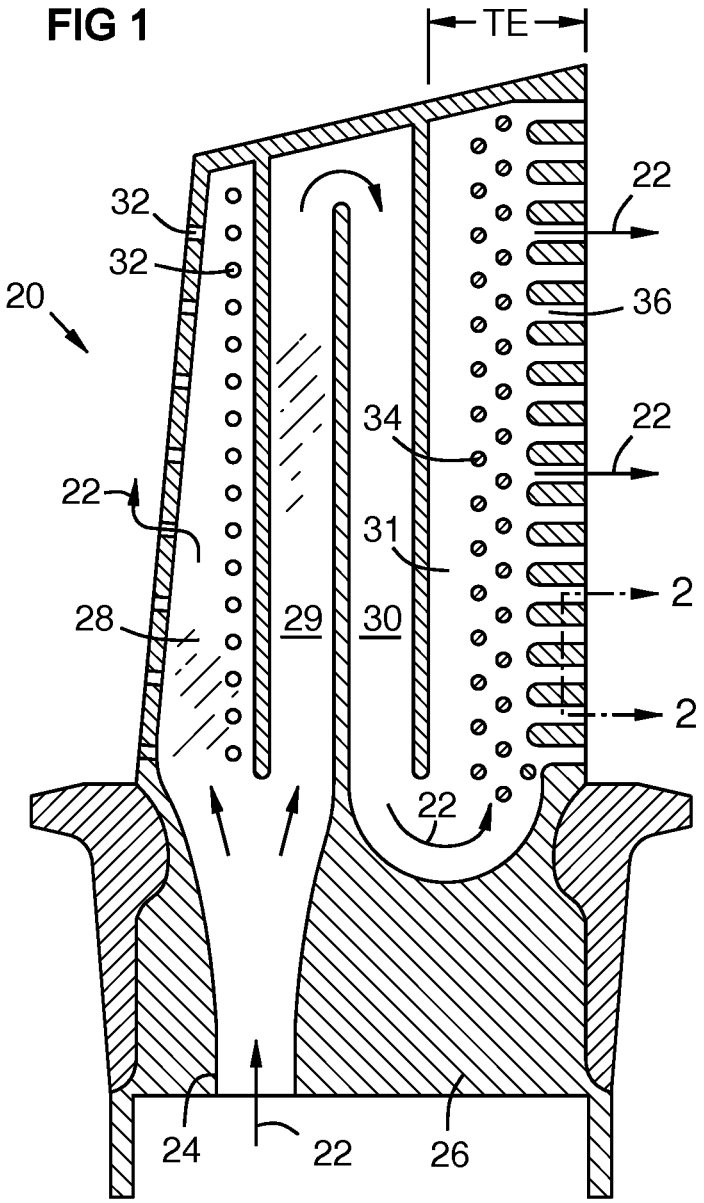
FIG. 1 is a sectional side view of a turbine blade with cooling channels.

FIG. 1 is a sectional view of a turbine blade 20. Cooling air 22 from the turbine compressor enters an inlet 24 in the blade root 26, and flows through channels 28, 29, 30, 31 in the blade. Some of the coolant may exit film cooling holes 32. A trailing edge portion TE of the blade may have turbulator pins 34 and exit channels 36. A high-efficiency cooling channel is disclosed herein that is especially useful for exit channels 36.

FIG. 2 is a sectional view of a turbine airfoil trailing edge portion TE taken along line 2-2 of FIG. 1. The trailing edge portion has first and second exterior surfaces 40, 42. Cooling channels 36 may have fins 44 on near-wall inner surfaces 48, 50 according to aspects of the invention. Herein, "near-wall inner surface" means an interior surface of a near-wall cooling channel that is closest to the cooled exterior surface. Gaps G between channels produce gaps in cooling efficiency and cooling uniformity. The inventors recognized that cooling effectiveness, efficiency, and uniformity could be improved by preferentially increasing the cooling rate in the near-wall distal corners C of the cooling channels, since these corners are nearest to the gaps G. "Distal" here means at opposite sides of the near-wall inner surface 48, 50, as shown.

FIG. 3 is a transverse sectional profile 46 of a cooling channel that is shaped to efficiently cool two opposed exterior surfaces. It has two opposed near-wall inner surfaces 48, 50, which may be parallel to the respective exterior surfaces 40, 42. Here "parallel" means with respect to the parts of the near-wall inner surface closest to the exterior surface, not considering the fins 44. The channels 36 have a width W1 at the near-wall inner surfaces 48, 50. Two interior side surfaces 52, 54 may taper toward each other from the sides of the near-wall inner surfaces 48, 50, thus defining a minimum channel width W2 between them at a waist between the near-wall inner surfaces. Thus, the near-wall width W1 is greater than the minimum channel width W2. The channel profile 46 may have an hourglass shape formed by convexity of the side surfaces 52, 54. This shape increases the coolant flow 22 along the near-wall distal corners C of the channel. The coolant flow is mostly normal to the page in this view. Arrows 22 illustrate a flow-increasing aspect of the profile 46.

The fins 44 may have heights that follow a convex profile such as 56A or 56B, providing a maximum fin height H at mid-width of the near-wall inner surface 48. These fins 44 increase the surface area of the near-wall surfaces 48, 50, and also increase the flow in the corners C. The taller middle fins slow the flow 22 centrally, while the shorter distal fins allow faster flow in the corners C. The combination of convex sides 52, 54 and convex fin height profile 56A, 56B has a synergy that focuses cooling toward the channel corners C.

Dimensions of the channel profile 46 may be selected using known engineering methods. The following proportions are provided as an example only. These length units are dimensionless and may be sized proportionately in any unit of measurement or scale, since proportion is the relevant aspect exemplified in this drawing. In one embodiment, angle A=60°, and the relative dimensions are B=1.00, D=0.05, H=0.20, W1=1.00, W2=0.60. Here, the minimum channel width W2 is 60% of the near-wall width W1. In general, the minimum channel width W2 may be 80% or less of the near wall width W1, or 65% or less in certain embodiments. One or more proportions and/or dimensions may vary along the length of the cooling channel. For example, dimension B may vary somewhat with the thickness of the trailing edge without varying dimension H in one embodiment.

Figure 4:
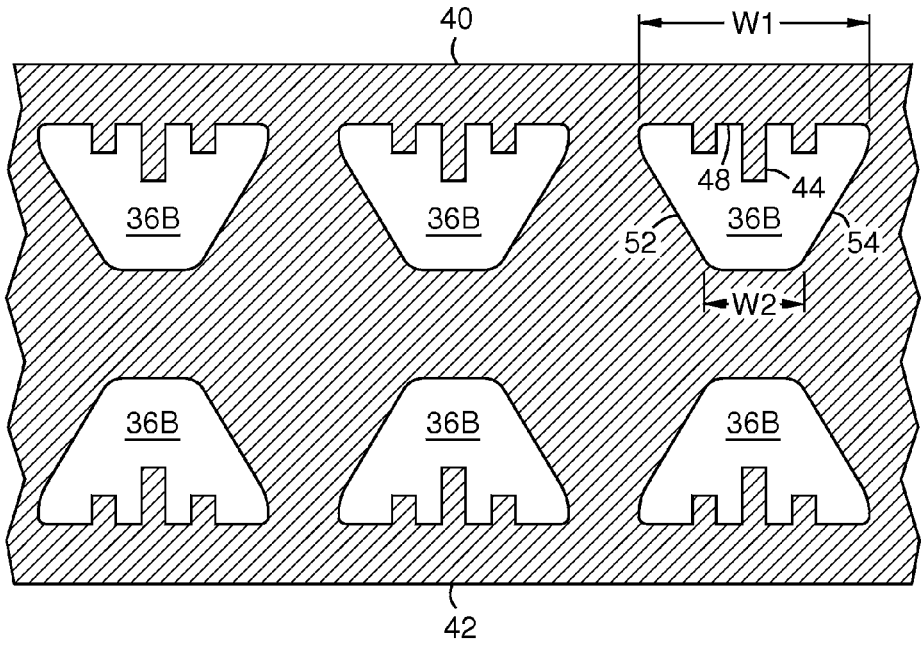
FIG. 4 is a sectional view of one-sided near-wall cooling channels.

FIG. 4 shows a cooling channel 36B that is shaped to cool a single exterior surface 40 or 42. It uses the concept of the two-sided cooling channel 36 previously described. The near-wall inner surface width W1 is greater than the minimum channel width W2 due to tapered interior side surfaces 52, 54. Fins 44 may be provided on the near-wall inner surface 48, and they may have a convex height profile centered on the width W1 of the near-wall inner surface. Such cooling channels 36B may be used for example in a relatively thicker part of a trailing edge portion TE of an airfoil rather than the relatively thinner part of the trailing edge portion TE where a two-sided cooling arrangement 36 might be used. The transverse sectional profile of this embodiment may be trapezoidal, and the near-wall inner surface 48 defines a longest side thereof.

Figure 5:
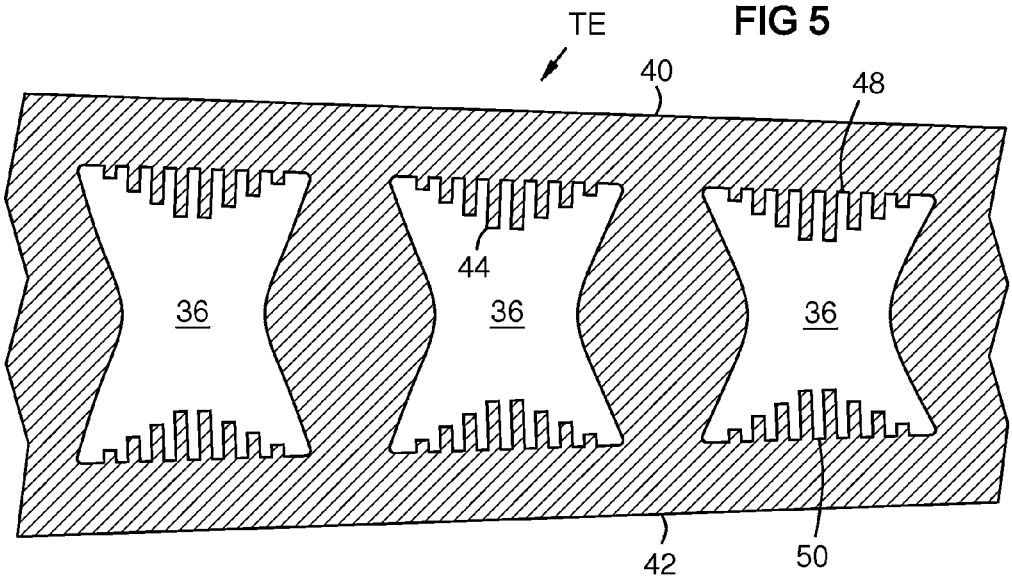
FIG. 5 is a sectional view of cooling channels with non-parallel near-wall inner surfaces.

FIG. 5 shows that the exterior surfaces 40 and 42 may be non-parallel in a transverse section plane of the channel 36. This can happen in a tapered component such as a trailing edge portion TE if the channel direction is either diagonal or orthogonal to the TE taper direction. The near-wall inner surfaces 48, 50 may be parallel to the exterior surfaces 40, 42.

The present channels 36, 36B are useful in any near-wall cooling application, such as in vanes, blades, shrouds, and possibly in combustors and transition ducts of gas turbines. They are ideal for a parallel series of small, near-wall channels, such as trailing edge coolant exit channels of airfoils, because they increase the uniformity of cooling of a parallel series of channels. The present channels may be formed by any known fabrication technique—for example by casting an airfoil over a positive ceramic core that is chemically removed after casting.

A benefit of the invention is that the near-wall distal corners C of the channels remove more heat than in prior cooling channels for a given coolant flow volume. This improves efficiency, effectiveness, and uniformity of cooling by overcoming the tendency of coolant to flow slower in the corners. Increasing the corner cooling helps compensate for the cooling reduction in the gaps G between channels. The invention also provides increased heat transfer area along the primary surface to be cooled through the use of the fins 44 which are not used along other surfaces of the cooling channel.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A cooling channel in a component, the cooling channel comprising:

a first near-wall inner surface parallel to a first exterior surface of the component;

a first plurality of parallel fins on the first near-wall inner surface that are aligned with a flow direction of the cooling channel;

wherein the first plurality of parallel fins comprises a height profile that is convex across a width of the first near-wall inner surface as viewed in a transverse section plane of the cooling channel, wherein the transverse section plane is normal to the flow direction; and first and second interior side surfaces that taper toward each other from respective first and second opposite sides of the first near-wall inner surface to define a reduced channel width away from the first near-wall inner surface that is 80% or less of the width of the first near-wall inner surface as viewed in the transverse section plane.

2. The cooling channel of claim 1, further comprising:

a second near-wall inner surface parallel to a second exterior surface of the component; and a second plurality of parallel fins on the second near-wall inner surface that are aligned with the flow direction of the cooling channel;

wherein the second plurality of parallel fins comprises a height profile that is convex across a width of the second near-wall inner surface as viewed in the transverse section plane.

3. The cooling channel of claim 2, wherein the first and second interior side surfaces are convex, and define an hourglass shaped transverse sectional profile of the cooling channel with a waist width that is less than the width of the first near-wall inner surface.

4. A series of cooling channels according to claim 2, forming coolant exit channels in a trailing edge portion of a turbine airfoil.

5. The cooling channel of claim 1, wherein a transverse sectional profile of the cooling channel is trapezoidal, and the first near-wall inner surface defines a longest side thereof.

6. A first series of cooling channels according to claim 5, each of which is parallel to the first exterior surface of the component, and a second series of cooling channels according to claim 5, each of which is parallel to a second exterior surface of the component, the first and second exterior surfaces of the component defining a trailing edge portion of a turbine airfoil.

7. A turbine airfoil comprising the cooling channel of claim 1.

8. A coolant exit channel in a trailing edge portion of a turbine airfoil, comprising:

a first near-wall inner surface parallel to a first exterior surface of the trailing edge portion;

two interior side surfaces that taper toward each other from opposite sides of the first near-wall inner surface to a minimum channel width that is 80% or less of a width of the near-wall inner surface as viewed in a transverse section plane of the cooling channel, wherein the transverse section plane is normal to a flow direction of the coolant exit channel; and a plurality of fins on the first near-wall inner surface that are aligned with the flow direction of the coolant exit channel, the plurality of fins following a convex height profile across the width of the first near-wall inner surface as viewed in the transverse section plane of the cooling channel.

9. The coolant exit channel of claim 8, further comprising:

a second near-wall inner surface parallel to a second exterior surface of the trailing edge portion; and a second plurality of parallel fins on the second near-wall inner surface that are aligned with the flow direction of the coolant exit channel, and that follow a convex height profile across a width of the second near-wall inner surface as viewed in the transverse section plane of the cooling channel; and wherein the two interior side surfaces span between respective first and second sides of the first and second near-wall inner surfaces, forming a tapered shaped transverse sectional profile of the coolant exit channel as viewed in the transverse section plane of the cooling channel.

10. The coolant exit channel of claim 8, wherein a transverse sectional profile of the coolant exit channel is trapezoidal, and the first near-wall inner surface defines a longest side thereof.

11. A first series of cooling channels according to claim 8, each of which is parallel to the first exterior surface of the trailing edge portion, and a second series of cooling channels according to claim 8, each of which is parallel to and relates to a second exterior surface of the trailing edge portion.

12. A cooling channel in a component, the cooling channel comprising:

a first near-wall inner surface parallel to a first exterior surface of the component;

a tapered transverse sectional profile that is wider at the first near-wall inner surface and narrower away from the first near-wall inner surface as viewed in a transverse section plane of the cooling channel, wherein the transverse section plane is normal to a flow direction of the coolant exit channel; and at least one cooling fin on the first near-wall inner surface aligned with the flow direction of the cooling channel;

wherein the cooling channel guides a coolant flow therein preferentially toward near-wall distal corners of the cooling channel as viewed in the transverse section plane of the cooling channel.

13. The cooling channel of claim 12, comprising a plurality of cooling fins on the first near-wall inner surface aligned with the flow direction, wherein the plurality of cooling fins range in height, being tallest at a mid-width of the first near-wall inner surface as viewed in the transverse section plane of the cooling channel.

14. The cooling channel of claim 13, further comprising:

a second near-wall inner surface parallel to a second exterior surface of the component; and a second plurality of cooling fins on the second near-wall inner surface, the second plurality of cooling fins aligned with the flow direction of the cooling channel;

wherein the second plurality of cooling fins range in height, being tallest at a mid-width of the second near-wall inner surface as viewed in the transverse section plane of the cooling channel; and first and second interior side surfaces between respective first and second sides of the first and second near-wall inner surfaces.

15. The cooling channel of claim 14, wherein the first and second interior side surfaces are convex, and define an hourglass shape in a transverse sectional profile of the cooling channel, the hourglass shape comprising a waist width that is 65% or less of a width of the first near-wall inner surface.

16. A series of cooling channels formed according to claim 14 as coolant exit channels in a trailing edge portion of a turbine airfoil.

17. A first series of cooling channels formed according to claim 14, each of which is parallel to the first exterior surface of the component, and a second series of cooling channels formed according to claim 14, each of which is parallel to and relates to a second exterior surface of the component.

18. The series of cooling channels of claim 17 forming coolant exit channels in a trailing edge of a turbine airfoil.

* * * * *